United States Patent [19]

Oettli

[11] Patent Number: 4,651,139

[45] Date of Patent: Mar. 17, 1987

[54] METHOD FOR MONITORING THE DRIFT OF AN ANCHORED VESSEL AND DEVICE FOR IMPLEMENTING THE METHOD

[76] Inventor: Martin W. Oettli, Grabenackerstrasse 43, 6312 Steinhausen, Switzerland

[21] Appl. No.: 622,541

[22] Filed: Jun. 20, 1984

[30] Foreign Application Priority Data

Jun. 22, 1983 [CH] Switzerland ..... 3421/83

[51] Int. Cl.[4] ..... G08B 1/00; G08B 21/00

[52] U.S. Cl. ..... 340/531; 340/539; 340/986; 114/294; 310/311; 73/505; 73/DIG. 4

[58] Field of Search ..... 340/531, 539, 850, 870.1, 340/870.01, 986, 984; 200/61.44; 114/206, 294, 293; 73/862.39, 178 R, 862.07, 309, 318, 321, 505, DIG. 4, 170 A, 493; 310/311, 322, 313 R

[56] References Cited

U.S. PATENT DOCUMENTS

| | | | |
|---|---|---|---|
| 3,690,285 | 9/1972 | Ellison | 340/986 |
| 3,759,094 | 9/1973 | Al | 340/984 |
| 3,956,742 | 5/1976 | Karl | 340/984 |
| 3,972,038 | 7/1976 | Fletcher et al. | 73/493 |
| 4,000,658 | 1/1977 | Schmidt | 73/493 |
| 4,058,792 | 11/1977 | Soltesz | 340/986 |
| 4,337,462 | 6/1982 | Lemelson | 340/539 |
| 4,347,743 | 9/1982 | Rausche et al. | 73/493 |
| 4,515,013 | 5/1985 | Hue | 73/170 A |

FOREIGN PATENT DOCUMENTS

| | | | |
|---|---|---|---|
| 0007575 | 1/1982 | Japan | 340/986 |

*Primary Examiner*—Donnie L. Crosland
*Attorney, Agent, or Firm*—Paul & Paul

[57] ABSTRACT

The drift of a boat which lies at anchor is monitored by a piezoelectrical accelerometer which is fixed to the anchor and will be subjected to sharp accelerations in case the anchor is pulled over the ground. The signals emitted by the accelerometer are transmitted to the boat through a multiple strand conductor which is led to the boat parallel to the anchor chain. The transmitted signals are then compared with a preset threshold value. When this threshold value is exceeded, an alarm is triggered. In order to avoid fouling the anchor chain with the electrical cable the latter is wound on a drum, which always exerts a slight pull on the cable.

25 Claims, 4 Drawing Figures

METHOD FOR MONITORING THE DRIFT OF AN ANCHORED VESSEL AND DEVICE FOR IMPLEMENTING THE METHOD

BACKGROUND OF THE INVENTION

1. Field of the Invention

The problem of monitoring a possible drift of a vessel that lies at anchor, especially in darkness and in bad weather conditions, is known of old and has led to the institution known to the professionals as anchor watch. This comprises the periodic check of the ship's exact position by a member of the crew, usually by taking sights of landmarks. However, this solution is not entirely adequate for the crews of the present-day, numerous pleasure crafts, which are mostly crewed by amateurs. Moreover, the crews of such vessels often lack the experience, largely available in former days on small ships, which allows to decide on grounds of the weather conditions, whether there is a need to keep an anchor watch, which generally is considered an unpleasant duty.

2. Description of the Prior Art

Even the most modern navigation instruments like the depth sounder or Satnav are still not precise enough to register in good time the small changes in the position of a ship which indicate that an anchor is being pulled or has broken out.

SUMMARY OF THE INVENTION

It is, therefore, an aim of the invention to provide a method for monitoring possible shifts in the position of a ship lying at anchor, and also to provide a device which allows to implement the method. In consequence the invention is defined as set forth in the claims.

Extensive experiments have shown that one may fix commercially available, comparatively cheap acceleration pick-offs to a body in order to determine from their output signals whether the body which lies on the ground (and which may be fastened to an anchor or not) remains at rest or whether it is being pulled along the ground. Distinguishing such signals by means of an electronic receiver station on board a vessel, to which the body is attached by a rope or the like, provides a very appreciable safety measure, particularly in bad weather and when visibility is poor.

BRIEF DESCRIPTION OF THE DRAWINGS

The invention shall now be described in more detail which the help of embodiments of the same and of the drawings, in which.

DESCRIPTION OF THE PREFERRED EMBODIMENTS

Figure 1:
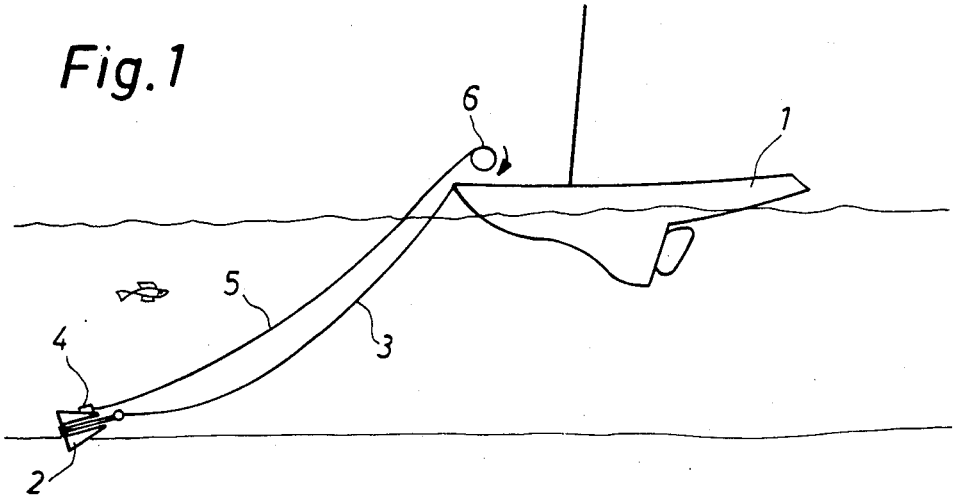
FIG. 1 is a schematic presentation of a boat which lies at anchor and uses one embodiment of the invention.

In FIG. 1 a boat 1 lies at an anchor 2, with which it is connected through an anchor chain 3. This anchor chain may, as is usual with small vessels, consist of a short length of chain shackled to the anchor and connected to the vessel by means of an anchor rope. A watertight housing 4 is fixed on the anchor 2 and contains a three-axial piezoelectrical pick-off and also a preamplifier circuit which is connected to the outputs of the pick-off. The preamplifier circuit is connected to the boat 1 through an insulated three-strand electrical cable 5. The three leads of this cable are used both for feeding the preamplifier with the necessary current and also for the transmission of preamplified signals derived from the output signals of the pick-off. On board the boat the cable is wound on a drum 6 which comprises means (not shown in the drawing) which enable it to always exert a certain pull on the cable, in the direction of the arrow. As a result, the cable will always remain under a moderate tension independently of the movements of the boat 1 due to waves and other factors. Among other things, this tension avoids a mutual interference between the cable 5 and the anchor chain 3. A receiver station (FIG. 4, not shown in FIGS. 1 and 2) is electrically connected with the cable 5 ending on the drum 6. In the drawing the anchor 2 is shown in the shape of a Danforth anchor, because the flat flukes of this type of anchor allow a particularly simple mounting of the housing 4, which can be directly screwed on. But practically any other type of anchor may also be used. Also, for reasons of clarity, FIG. 1 shows a transmission cable 5 which is hanging entirely free from the housing 4 until the drum 6, but it will often be advantageous to use an electrical cable the first part of which is protected by a strong sheath and runs along the shank of the anchor to the ring of the same and for a certain length along the anchor chain before it separates from the same and takes its own path to the drum 6.

Figure 4:
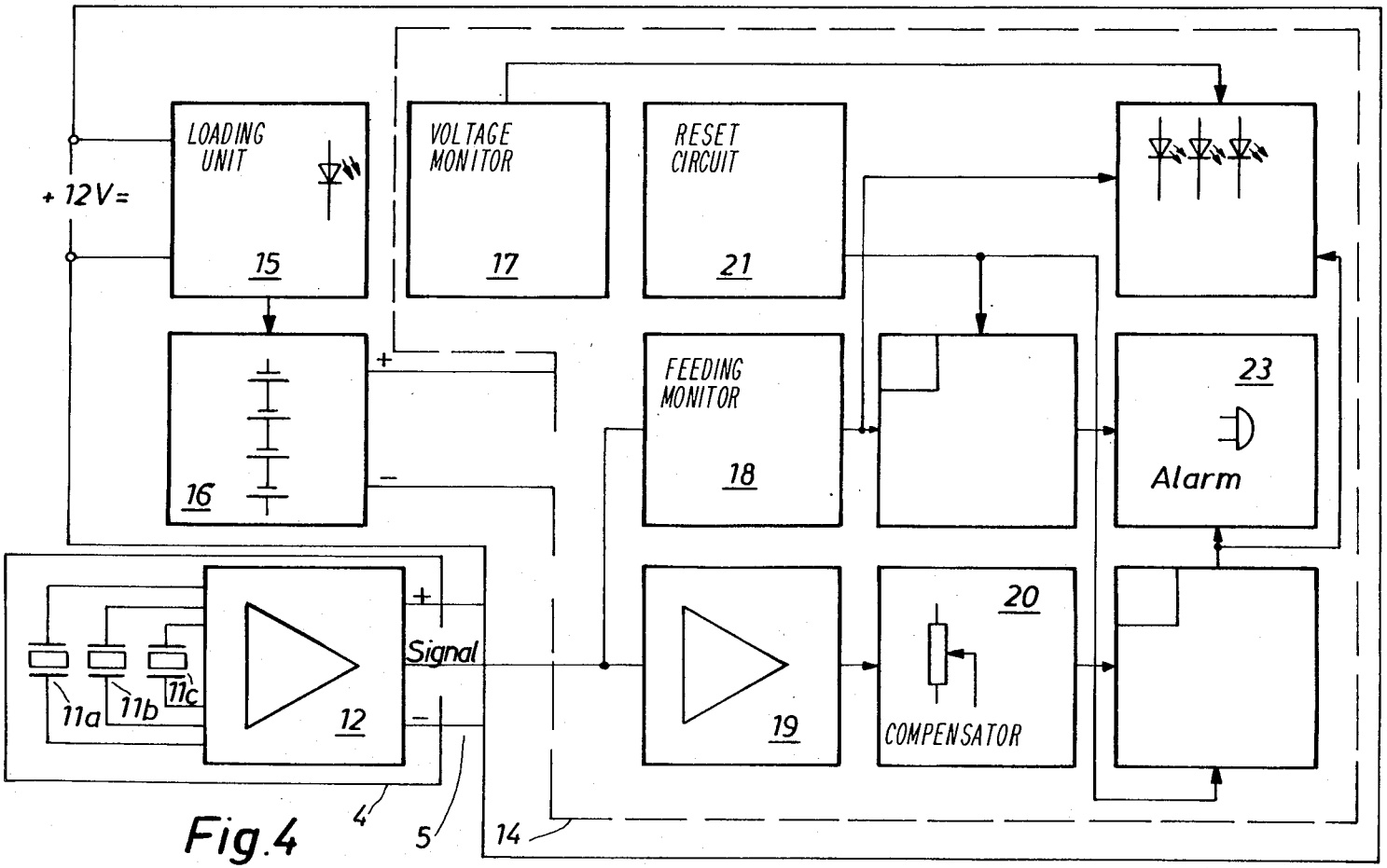
FIG. 4 is a block diagram of a receiving station.

From the drum 6 the three strands of the cable 5 run to a receiving station which is sketched in FIG. 4 and is located on board the boat. It is to be noted that this so-called receiving station is not used exclusively for the reception and the processing of signals but also, among other things, for feeding the preamplifier with current and for checking whether the whole device is in an operative state.

In FIG. 4 the housing which is fixed to the boat is again sketched and labeled with reference number 4. The reference numbers 11*a*, 11*b* and 11*c* identify piezoelectrical accelerometers which are mutually orthogonal and 12 identifies the corresponding preamplifier circuit. Reference number 5 identifies the three stranded connection cable between the boat and the anchor, and reference number 14 identifies the whole receiving station. A loading unit 15 which takes its energy from the mains of the boat (not shown) loads a dedicated accumulator 16 which in turn provides the current for the receiving station 14 in order to obtain the greatest possible security. The essential parts of this circuit are: a voltage monitor 17, a feeding monitor 18, an amplifier 19 for incoming signals, a compensator 20, which may be set so as to decide whether a given threshold is obtained, a reset circuit 21 and an alarm circuit 23, which is driven by the compensator 20 and the circuit 21.

These electrical circuits which are known per se, and if needed further ancillary circuits, are connected in a way evident to a specialist in electronics in order to provide the following functions: Checking the loading state of the accumulator 16 and showing on a display whether the current reserve is large enough, feeding and checking the preamplifier 12, monitoring the piezoelectrical pick-offs 11*a*, 11*b* and 11*c*, monitoring the state of the electrical conductors of the cable 5, checking whether one or several among the accelerations recorded by the pick-offs 11 exceed a predetermined value, triggering a corresponding alarm under certain predetermined conditions, and providing a manual reset of the entire device into the state in which it was before the alarm was triggered.

The practical use of the device can be described approximately as follows. After dropping the anchor the device is switched on and checked with regard to its performance and also with regard to the existence of a sufficient energy reserve. Then the compensator is adjusted until the signals which are received from the piezoelectrical pick-offs when the anchor holds are smaller than the chosen threshold value by a certain amount. The threshold value which is thus chosen can be dependent on the state of the sea, of the kind of anchoring ground, of the type of anchor and of the kind of anchor chain which is used. As a rule, the threshold value will not be exceeded as long as the anchor holds. If, however, the anchor breaks out and is being pulled along the ground, then it will be submitted to such sharp, if possibly short, accelerations even on a sandy or muddy ground, that the output signals of the acceleration pickoffs 11*a*, 11*b* and 11*c* will be such that the preset threshold value in the receiving station is exceeded, which causes the alarm to be triggered. The necessary safety measures can then be taken. In order to avoid false alarms due to the rumbling of the anchor chain when the preset value of the threshold is comparatively low, it can be advantageous to insert a short length of rope between the anchor chain and the anchor.

Figure 2:
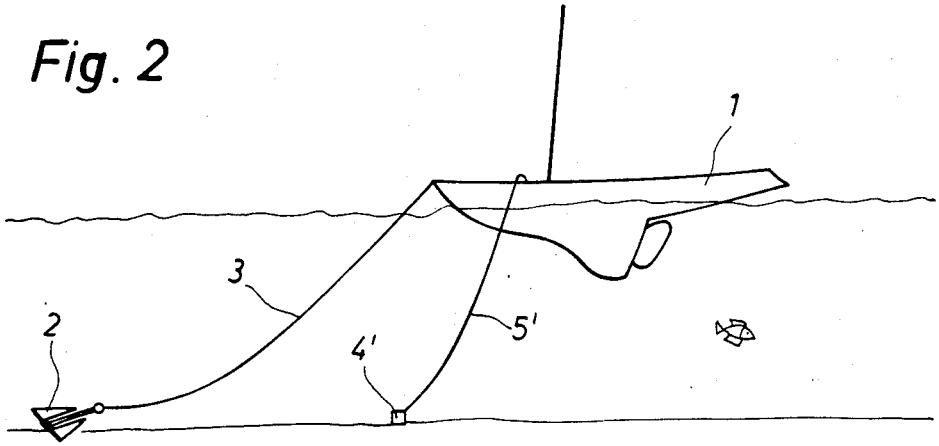
FIG. 2 also shows a boat which lies at anchor but which uses another embodiment of the invention.

If it is not expected that the boat will swing at anchor, say because it lies between a bow anchor and a stern anchor, or if one wants to be warned if the boat swings, in a crowded anchorage for instance, then it can be useful to lay the housing 4' which contains the piezoelectrical pick-offs directly on the ground, at the end of a short length of rope 5' and independently of the anchor 2, as shown in FIG. 2. The drum 6 then becomes unnecessary and the rope 5' (or even directly the electrical cable which connects the housing with the boat) can be made fast directly on board. It is obvious that under these conditions any swinging of the boat due to wind or current conditions will be recorded, even if the anchor does not move, because the housing 4' will be pulled along the ground and hence subject to accelerations. It is possible to regulate the amount by which the boat can swing around its anchor before giving an alarm by adjusting the length of the rope 5'.

Figure 3:
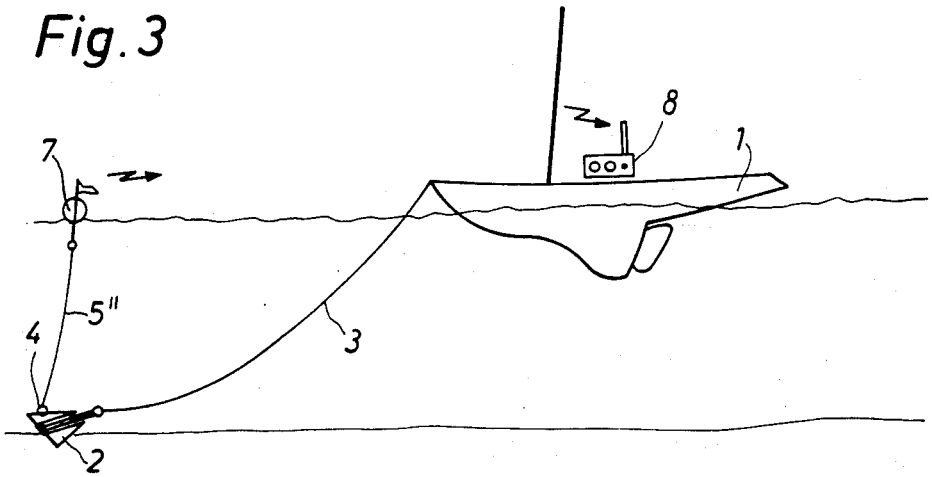
FIG. 3 shows an embodiment of yet a further realization of the method.

As shown in FIG. 3, it is further possible to lead the output signals of the piezoelectrical pick-offs through a comparatively short cable 5'' to an anchor buoy 7 which contains a radio emitter (not shown in the drawing). From there, a wireless transmission of the signals to a corresponding receiver 8 on board the boat is performed. In this case the emitter station must include its own energy supply; on the other hand this solution allows under certain conditions to avoid the use of a preamplifier; this reduces the bulk of the unit which is fixed to the anchor, and also makes it more failure resistent. This solution is especially adapted to difficult anchoring ground, where a marking buoy will be used in any case.

In yet another embodiment the housing fixed to the anchor may contain an ultrasonic wave emitter which monitors the output signals of the pick-offs and transmits corresponding ultrasonic signals directly to an ultrasonic receiver station installed on board the boat. This solution (not shown in the drawing) avoids all potential difficulties connected with the handling of electrical cables when anchoring.

While there are shown and described present preferred embodiments of the invention, it is to be distinctly understood that the invention is not limited thereto, but may be otherwise variously embodied and practiced within the scope of the following claims.

I claim:

1. Method for monitoring the position shifts of a body linked to a vessel which lies at anchor, characterized in that one deposits on the ground a body fitted with at least one accelerometer, this body being tied to the vessel by non-rigid linking means, and in that the acceleration signals emitted by the accelerometer are transmitted to the vessel.

2. Method according to claim 1, characterized in that the accelerometer generates electrical measuring signals which are transmitted to a receiver station on board the vessel through electrical conductors.

3. Method according to claim 1, characterized in that the accelerometer generates electrical measuring signals which are transmitted to a buoy through electrical conductors and then transmitted by radio waves to a receiver station on board the vessel.

4. Method according to claim 1, characterized in that the acceleration signals are transmitted from the body at least as far as the water surface by means of ultrasonic waves.

5. Method according to any of claims 1, or 2 or 3 or 4, characterized in that on board the vessel the signals are compared with a predetermined threshold value, and that an alarm signal is produced if the threshold value is exceeded.

6. Method according to claim 5, characterized in that the integrity of the signal paths and the performance of the accelerometer is checked periodically or continuously from on board the vessel and that a not-ready state is signalled if certain rated values are not attained.

7. Device for monitoring the position shifts of a body linked to a vessel which lies at anchor, comprising: a body adapted to be deposited on the ground beneath the water surface, non-rigid linking means connecting the body to the vessel, at least one piezoelectric pick-off and means for transmitting its output signals at least as far as the water surface, both the pick-off and the transmission means being mounted on or in the body. and a receiver station which repeatedly generates a measuring signal in response to the transmitted signals and is operative to trigger an alarm signal when the measuring indicates that the pick-off output signal exceeds a predetermined threshold value.

8. Device according to claim 7, characterized in that it comprises a floating radio emitter for transmitting the signals from the water surface to a radio receiver on board the vessel, this receiver being responsive to the signals emitted by the emitter.

9. Device according to claim 7, characterized in that it comprises three mutually orthogonal piezoelectric pick-offs.

10. Device according to claim 9, characterized in that it comprises a preamplifier common to all three pick-offs.

11. Device according to claim 10, characterized in that the preamplifier is located in the body.

12. Device according to claim 11, characterized in that the current supply for the preamplifier is provided by the receiving station.

13. Device according to any of claims 7, or 8 or 9 or 10 or 11 or 12, characterized in that the body is an hermetic enclosure attachable to the anchor, which enclosure contains the piezoelectric pick-off means.

14. Device according to claim 13, characterized in that the receiving station comprises means for checking the integrity of the signal paths, the performance of pick-off means, the signal processing circuits and the existence of a sufficient energy supply.

15. Device according to claim 13, characterized in that the means for transmitting the output signals at least as far as the water surface comprise means for emitting an ultrasonic signal in response to said output signal.

16. Apparatus for monitoring the position shifts of a body linked to a vessel which lies at anchor, comprising:

a body, adapted to being deposited on the ground, said body being fitted with accelerometer means for producing acceleration signals;

non-rigid linking means connecting said body to said vessel; and means for transmitting said acceleration signals to said vessel.

17. Apparatus according to claim 16, wherein said acceleration signals comprise electrical signals, and said means for transmitting comprises electrical conductors.

18. Apparatus according to claim 16, wherein said means for transmitting comprises a buoy having a radio transmitter.

19. Apparatus according to claim 16, wherein said means for transmitting comprises an ultrasonic transmitter.

20. Apparatus according to claim 16, further comprising receiving means associated with said vessel for receiving said acceleration signals.

21. Apparatus according to claim 20, wherein said receiving includes means for supplying electrical power to said accelerometer means through said non-rigid linking means.

22. Apparatus according to claim 20, wherein said receiving means includes comparison means and threshold means for producing threshold signals, said comparison means comparing said received acceleration signals with said threshold signals.

23. Apparatus according to claim 16, wherein said accelerometer means comprises at least one piezoelectric accelerometer.

24. Apparatus according to claim 16, wherein said accelerometer means comprises three mutually orthogonal piezoelectric accelerometers.

25. Apparatus according to claim 16, wherein said body is affixed to said anchor.

* * * * *